US009652919B2

(12) United States Patent
Chen et al.

(10) Patent No.: US 9,652,919 B2
(45) Date of Patent: May 16, 2017

(54) DYNAMIC AUTHENTICATION ADAPTOR SYSTEMS AND METHODS

(71) Applicant: DELL PRODUCTS L.P., Round Rock, TX (US)

(72) Inventors: YuLing Chen, Fremont, CA (US); Daniel A. Ford, Mount Kisco, NY (US)

(73) Assignee: DELL PRODUCTS LP, Round Rock, TX (US)

( * ) Notice: Subject to any disclaimer, the term of this patent is extended or adjusted under 35 U.S.C. 154(b) by 97 days.

(21) Appl. No.: 14/693,689

(22) Filed: Apr. 22, 2015

(65) Prior Publication Data

US 2016/0314635 A1 Oct. 27, 2016

(51) Int. Cl.
*G07C 9/00* (2006.01)

(52) U.S. Cl.
CPC . *G07C 9/00896* (2013.01); *G07C 2009/0092* (2013.01)

(58) Field of Classification Search
CPC ..... G07C 9/00111; G07C 9/00309; G07C 2009/00793; G07C 9/00103; G07C 9/00571; G07C 9/00182; G07C 2009/00634
USPC ..... 340/5.7
See application file for complete search history.

(56) References Cited

U.S. PATENT DOCUMENTS 7,038,585 B2 * 5/2006 Hall ..... B65D 7/00 220/200
7,671,741 B2 * 3/2010 Lax ..... E05B 73/0017 235/385
7,936,266 B2 * 5/2011 Francis ..... G09F 3/0335 340/539.13
9,191,228 B2 * 11/2015 Fulker ..... G06F 17/30873

OTHER PUBLICATIONS

Sikorsky, Autonomous VTOL Scalable Logistics Architecture Feasibility Study USRA Grant 07600-056, 25pgs.

(Continued)

*Primary Examiner* — Mark Blouin
(74) *Attorney, Agent, or Firm* — North Weber & Baugh LLP

(57) ABSTRACT

Various embodiments of the present invention provide for secure and flexible access to the contents of a smart package in the chain of transportation. In embodiments, access is automatically controlled by a security authentication adaptor based on an authentication mechanism that adapts to changing security environments during transportation. In embodiments, a level of required authentication is adjusted depending on situational, contextual awareness that is achieved via sensors coupled to a context state detector to monitor and detect a transportation state of the smart package. Based on the transportation state, a security state machine dynamically adjust a risk level associated with the transportation state and instructs an authentication module apply, in response to an authentication request, one or more authentication methods based on the risk level.

20 Claims, 5 Drawing Sheets

(56) References Cited

OTHER PUBLICATIONS

AZO Materials, "Smart Packaging—Intelligent Packaging for Food, Beverages, Pharmaceuticals and Household Products," Printed from the internet Jan. 24, 2015, URL:http://www.azom.com/article/aspx?ArticleID-2152#_How_Activated_p . . . , 5pgs.
DHL, "DHL Launches Smart Sentry Tracking Technology," printed from the internet Jan. 27, 2015, URL:http://www.supplychaindigital.com/logistics/2755/DHL-Launches-Smart . . . , 3pgs.

* cited by examiner

DYNAMIC AUTHENTICATION ADAPTOR SYSTEMS AND METHODS

BACKGROUND

A. Technical Field

The present invention relates to logistic systems and, more particularly, to systems, devices, and methods of protecting packages in the chain of transportation.

B. Background of the Invention

The delivery of cargo such as packages and parcels traveling through a transportation system is becoming increasingly automated. Generally, tracking management systems provide information that facilitates a determination of a location of a package in a delivery network at any moment during transportation from a place of origin to delivery at a final destination. Bar code scanners, computerized active (GPS) and passive (RFID tags) tracking devices that may be placed inside a package, and methods for authenticating parties are known in the art. Tracking systems may further aid in recovery efforts of lost or stolen packages, thereby, reducing cargo theft and losses.

However, currently no known protection system exist that would allow access to the contents of a package to users with different credentials in different security environments along the transportation chain. What is needed are systems and devices that increase the protection of assets traveling in packages while permitting expeditious and transparent processing and delivery of those packages.

BRIEF DESCRIPTION OF THE DRAWINGS

References will be made to embodiments of the invention, examples of which may be illustrated in the accompanying figures. These figures are intended to be illustrative, not limiting. Although the invention is generally described in the context of these embodiments, it should be understood that it is not intended to limit the scope of the invention to these particular embodiments.

DETAILED DESCRIPTION OF THE PREFERRED EMBODIMENTS

Figure 1:
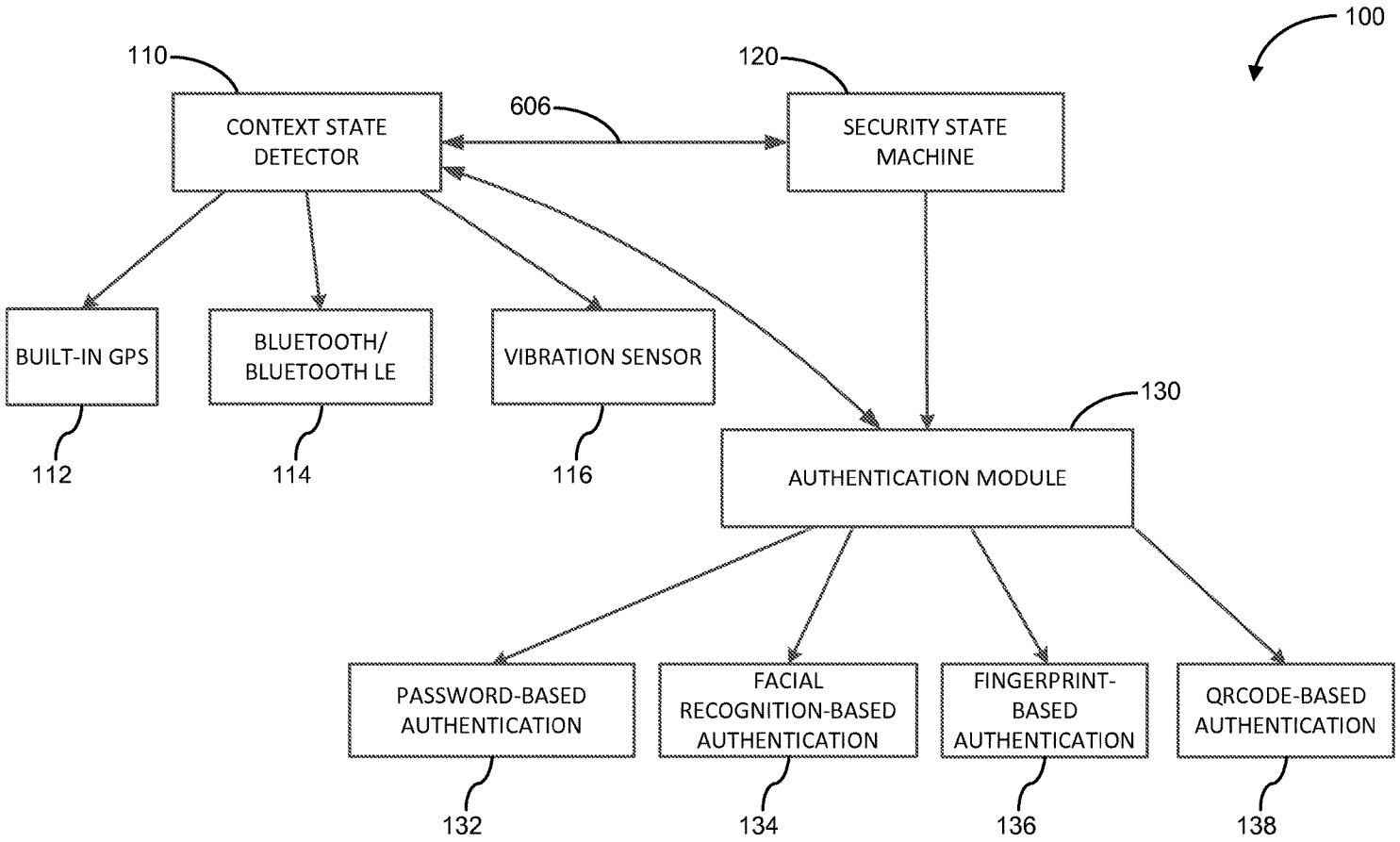
FIG. 1 illustrates an exemplary dynamic authentication adaptor system according to various embodiments of the invention.

In the following description, for purposes of explanation, specific details are set forth in order to provide an understanding of the invention. It will be apparent, however, to one skilled in the art that the invention can be practiced without these details. Furthermore, one skilled in the art will recognize that embodiments of the present invention, described below, may be implemented in a variety of ways, such as a process, an apparatus, a system, a device, or a method on a tangible computer-readable medium.

Components, or modules, shown in diagrams are illustrative of exemplary embodiments of the invention and are meant to avoid obscuring the invention. It shall also be understood that throughout this discussion that components may be described as separate functional units, which may comprise sub-units, but those skilled in the art will recognize that various components, or portions thereof, may be divided into separate components or may be integrated together, including integrated within a single system or component. It should be noted that functions or operations discussed herein may be implemented as components. Components may be implemented in software, hardware, or a combination thereof.

Furthermore, connections between components or systems within the figures are not intended to be limited to direct connections. Rather, data between these components may be modified, re-formatted, or otherwise changed by intermediary components. Also, additional or fewer connections may be used. It shall also be noted that the terms "coupled," "connected," or "communicatively coupled" shall be understood to include direct connections, indirect connections through one or more intermediary devices, and wireless connections.

Reference in the specification to "one embodiment," "preferred embodiment," "an embodiment," or "embodiments" means that a particular feature, structure, characteristic, or function described in connection with the embodiment is included in at least one embodiment of the invention and may be in more than one embodiment. Also, the appearances of the above-noted phrases in various places in the specification are not necessarily all referring to the same embodiment or embodiments.

The use of certain terms in various places in the specification is for illustration and should not be construed as limiting. A service, function, or resource is not limited to a single service, function, or resource; usage of these terms may refer to a grouping of related services, functions, or resources, which may be distributed or aggregated. Furthermore, the use of memory, database, information base, data store, tables, hardware, and the like may be used herein to refer to system component or components into which information may be entered or otherwise recorded.

Furthermore, it shall be noted that: (1) certain steps may optionally be performed; (2) steps may not be limited to the specific order set forth herein; (3) certain steps may be performed in different orders; and (4) certain steps may be done concurrently.

In this document, the term "package" and "smart package" are used interchangeably. Package includes any container, parcel, or device, in a transportation system, such as a hard-case tamperproof clamshell configured to open, close, and lock itself for protection purposes and communicate, e.g., through Bluetooth, and respond to a challenge or request for authentication.

FIG. 1 illustrates an exemplary dynamic authentication adaptor system according to various embodiments of the invention. As depicted in FIG. 1, dynamic authentication adaptor 100 comprises context state detector 110, security state machine 120, and security authentication module 130. Dynamic authentication adaptor 100 may be integrated with a smart package (not shown). The smart package may be implemented as an enclosure that comprises a locking mechanism, a computing system for safeguarding the contents of the package, and a power source. The package may be manufactured, for example, from aircraft grade aluminum for enhanced security and durability.

As shown in example in FIG. 1, context state detector 110 is coupled to built-in GPS 112, Bluetooth or Bluetooth LE device 114, and vibration sensor 116. Security state machine 120 is coupled between context state detector 110 and authentication module 130. Security state machine 120 is any state machine known in the art and may be situated remotely from the package. Authentication module 130, as shown, is coupled to one or more devices 132-138 that are capable of authenticating a person or device requesting access to the contents of the package. Security authentication adaptor 100 may communicate with the requestor via an interface (not shown), such as a keypad, touch display, or any type of reader (e.g. a fingerprint reader) or user interface.

In embodiments, context state detector 110 comprises circuitry that is capable of determining a context state by using one or more of various types of sensors 112-116 that may be configured to detect and track a physical characteristic associated with the package from which, for example, a transportation state of the package can be identified. The transportation state may be detected, among other things, via a physical location of the package. In embodiments, sensors 112-116 may be remotely controlled during part of all of a shipment life cycle of the smart package. In embodiments, sensors 112-116 may be integrated with or use a computing system to monitor and protect the contents of the smart package.

In embodiments, context state detector detects the context of the smart package and communicates information to security state machine 120, e.g., via a wireless communications link (not shown). Based on the information, security state machine 120 may determine a risk level associated with the context state and communicate the result to authentication module 130, which, in turn, determines one or more authentication methods based on the risk level. Authentication module 130 applies one or more suitable authentication methods in response to an authentication request by the requestor.

A context state may include information about a transportation state of a package, a date, a value of the content, an intended recipient, and other factors that directly or indirectly relate to the package. In embodiments, context state detector determines information about the context of the smart package by querying one or more sensors. Based on information gathered from one or more sensors, context state detector 110 applies a set of predetermined rules (e.g., provided by a user) to enable a rule-based detection of the context state.

For example, built-in GPS may compare the current location of the package to a programmed location, such as a final destination, to determine whether the package has arrived at the recipient's place or is still in a transit state. In embodiments, context state detector utilizes vibration sensor to detect vibration patterns indicative of whether the package is in the process of transit. When the package resides in a courier's storage room, the context state detector may leverage Bluetooth or Bluetooth LE (e.g., via computing components, such as a Raspberry Pi,) to exchange information with a Bluetooth-enabled device, such as a wall-mounted device. The package may communicate with the device confirm that it is indeed in the courier's storage room awaiting release to a delivery transportation vehicle.

In embodiments, the determination of the context state or information related thereto, such as a current location, may occur periodically. For example, a current location may be compared to previous locations (e.g., once a minute). Upon detecting a certain pattern of location changes, context state detector may decide that the smart package is in the process of shipment in the transportation chain.

In embodiments, context information may provide context, and the context state detector exchanges information with security state machine 120 and/or authentication module 130. For example, upon the detection of a number of erroneous authentication attempts (e.g., more than 10 failed attempts using password-based authentication for accessing the content of the package, or a mismatch in facial recognition), context state detector 110 may conclude that the smart package has been stolen.

In embodiments, upon detection of a number of failed authentication attempts, or detecting an unexpected location, etc., the smart package may remain locked for a set period of time or render unusable its content, for example, by partial or complete destruction.

Similarly, in embodiments, to determine whether the smart package has been lost, context state detector 110 leverages feedback from a combination of detected conditions and/or the current state. For example, if the package is in a "In Delivery" state, but there has been no change in terms of location according to the location information captured in the previous 24 hours, context state detector 110 may conclude that the status of the package is lost.

Figure 2:
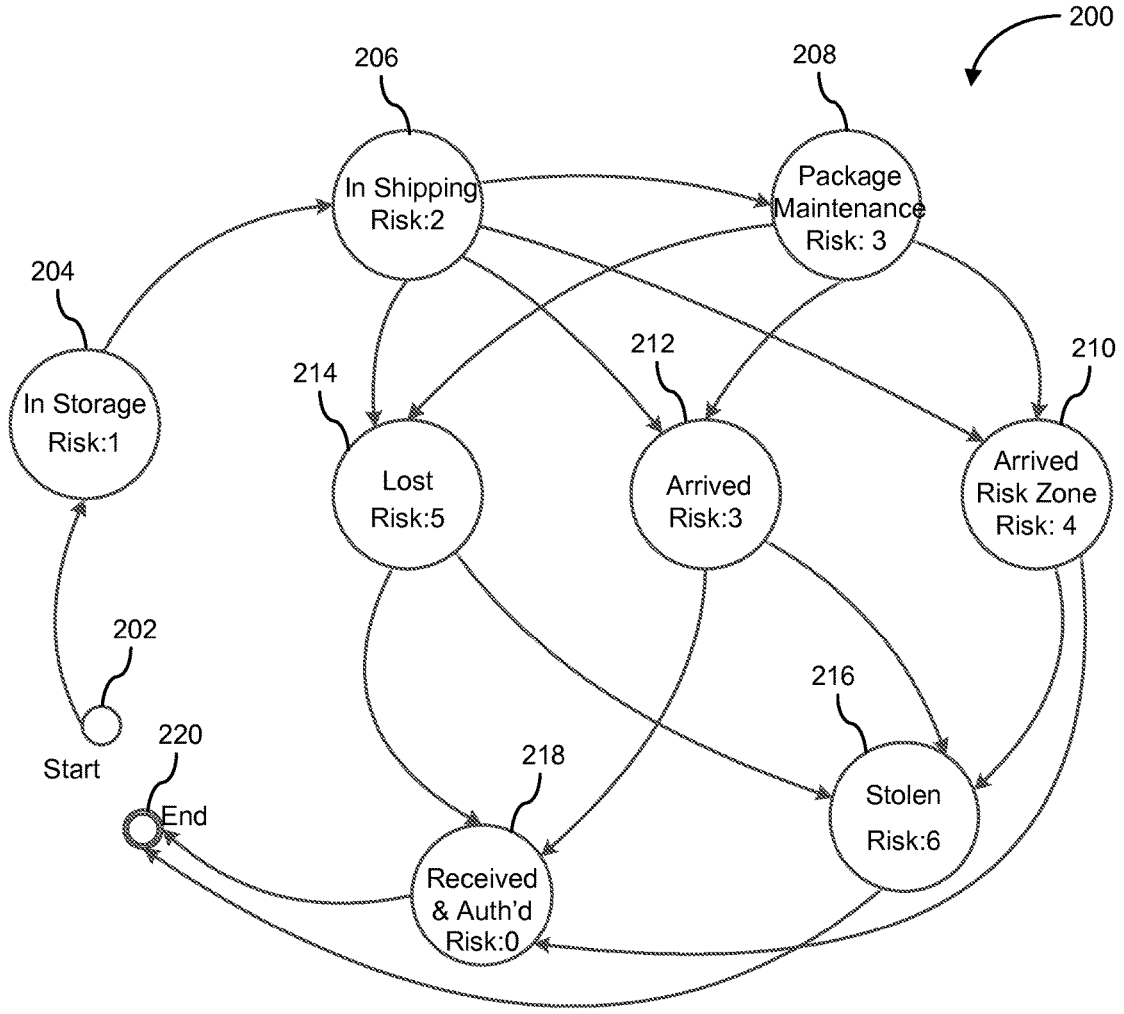
FIG. 2 illustrates a context state diagram for exemplary transportation cycles of a smart package, according to various embodiments of the invention.

In embodiments, security state machine 120 dynamically determines a risk level associated with a context state and communicates the results to authentication module 130 for further processing. FIG. 2 illustrates a context state diagram 200 for exemplary transportation cycles of a smart package, according to various embodiments of the invention. Transportation states of the smart package, as shown, include a start 202 of the transportation cycle, when the package is prepared for shipping, through arrival at a destination at the end 220 of the transportation cycle. It is understood that the destination may coincide with the beginning or any other location. Transportation states depicted in FIG. 2 include "in storage" 204, "in shipping" 206, "in package maintenance" 208, "arrived in a risk zone" 210, "arrived" 212, "lost" 214, "stolen" 206, and "received and authorized" 218.

As shown, machine states 202-220 are associated with security risk levels (1-6) for various transportation states 204-218, such that for each change in transportation state 204-218, the security risk level may also change. It is noted, however, that the security risk level does not necessarily have to change each time the transportation state changes. Furthermore, security risk level may be adjusted to account for other or additional factors related to the package.

Transportation states 204-218 correspond to the smart package being exposed to different security environments, including being the courier company's storage room, which may be assigned the lowest risk level as the smart package may be considered in custody of a trusted agent that may open and close the smart package multiple times (e.g., to add to the content). Once the smart package leaves the storage room for transportation on a ship, plane, truck, etc., the security environments may be assigned a medium risk level as the smart package may be in public transportation that is shared by people other than working staff of the courier company. Upon delivery to the front door of a recipient the risk level may be adjusted higher based on the safety of the neighborhood.

In addition, multiple intermediate stops during transportation of the smart package, differing processing and handling scenarios during international transportation, and other security environments may benefit from adjusting the risk level according to the transportation state. In embodiments, a mapping between transportation states and security risk states is performed by security state machine 120 according to user-configurable rules that are based on the transportation state or other any other state.

With reference to FIG. 1, in embodiments, once context state detector 110 detects a transportation state change, context state detector 110 updates security state machine 120 with the current transportation state, such that security state machine 120 can update the security risk level according to the security environment to raise the difficulty of successfully passing a verification process. For example, when context state detector 110 detects a transportation state change from "in shipping" to "arrived in a bad neighborhood," context state detector 110 may instruct security state machine 120 to elevate the current security risk state from a level "2" to a level "4" (or from "medium risk" to "extremely high risk") to require a more stringent acceptable authentication method to access the contents of the smart package.

In embodiments, in instances when context state detector 110 cannot determine context state within a certain period of time, for example, due to an interruption in communication with one or more sensors, security state machine 120 reverts to a default state, for example, the highest possible security setting and may cause the smart package to remain locked for a certain length of time.

In embodiments, upon a determining a change in the security risk state, security state machine 120 notifies to authentication module 130 of the new security risk state. In response, authentication module 130 chooses one or more corresponding authentication methods based on the security risk state and applies the method(s) in response to a request for authorization to validate the request and authorize access to the smart package. In embodiments, security authentication adaptor 100 generates a notification in response to a (failed) authentication request.

Authentication methods may include password protection 132, biometric recognition, such as facial recognition 134 or finger print scanning 136, QR code 138, and any other recognition technology known in the art. It is noted that combining two or more authentication methods may increase the difficulty level of gaining access to the content of the package. In this manner, the most appropriate authentication method(s) will depend on the risk level associated with the context state.

For example, after the smart package arrives at a recipient's location and a person attempts to open the package, authentication module 130 may prompt a user to input a password followed by a fingerprint check to ensure that the user is the intended recipient of the package or is otherwise authorized to open it. In contrast, in a scenario where the package in situated in a relatively secure environment having a low security risk, such as the courier company's storage room that is equipped to require additional authorization for entry (e.g., a badge to enter the room) or in a customs office no fingerprint prompt would be issued.

In embodiments, by applying different authentication mechanisms requiring different levels of credentials for different transportation states, security requirements for successful authentication are balanced with expeditious processing or a convenience factor, thereby, enhancing user experience.

Figure 3:
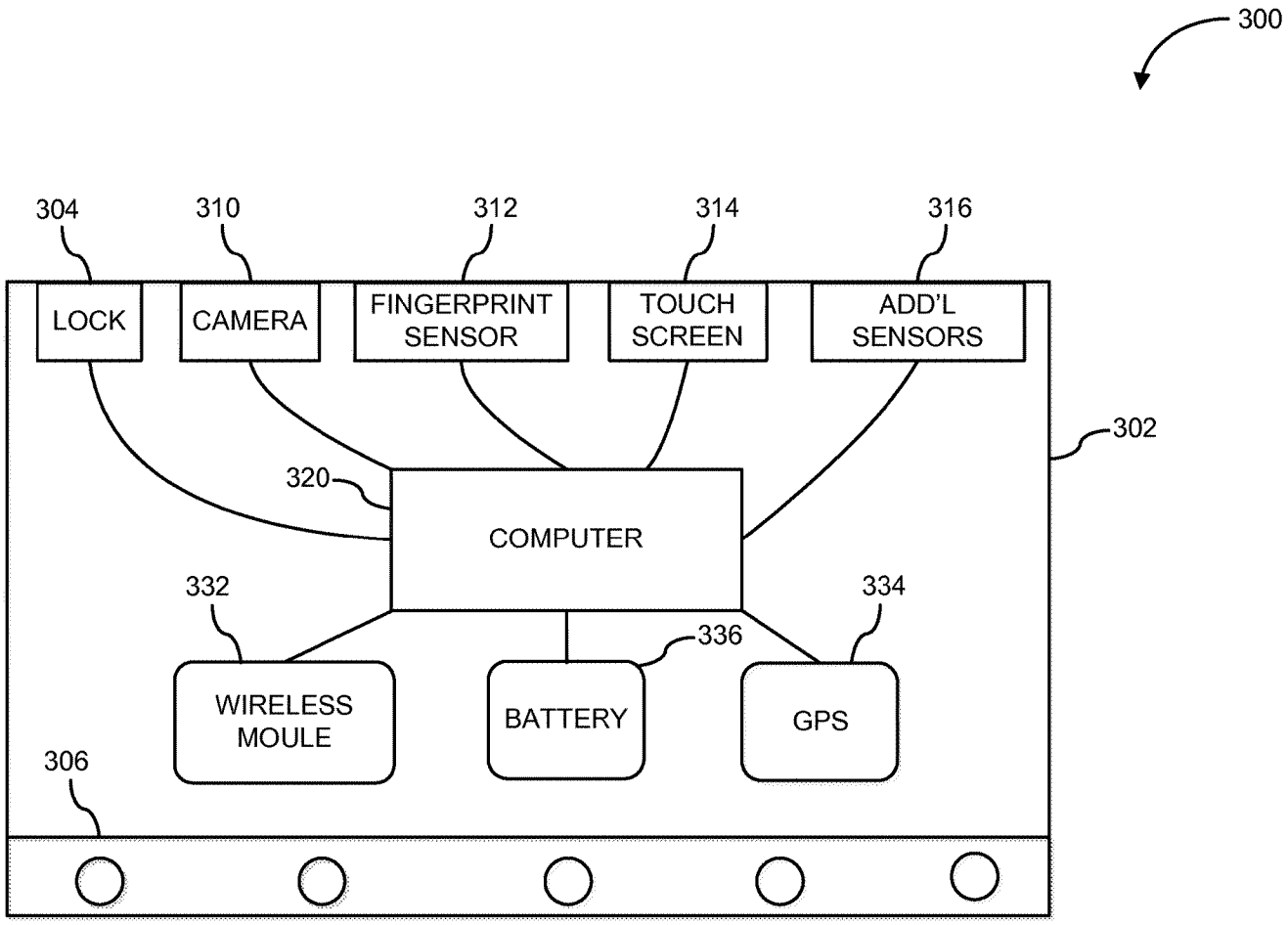
FIG. 3 illustrates an exemplary smart package using an exemplary dynamic authentication adaptor system according to various embodiments of the invention.

FIG. 3 illustrates an exemplary smart package using an exemplary dynamic authentication adaptor system according to various embodiments of the invention. In embodiments, smart package 300 comprises container 302 having lock 304 and hinges 306, camera 310, fingerprint sensor 312, touch screen 314, computer 320, wireless module 332, GPS module 334, and battery 336. In embodiments, smart package 300 may be implemented as any lockable container, parcel, or device that is capable of protecting its contents, including a lockable clamshell design. One skilled in the art will appreciate that smart package 300 may be implemented in any shape and be made from any material or combination of materials. In embodiments, smart package 300 comprises additional sensors, such as a vibration sensor, that are coupled to computer 320. Computer 320 may be any computing system with a processor and connectivity to peripherals and may be powered by power source, such as a battery.

In operation, computer 320 directly or indirectly communicates with and controls lock 304 and sensors 310-316, for example, via an input or output pin(s), such as a GPIO (not shown). In embodiments, one or more components of smart package 300 communicate through wireless module 332 (e.g. Bluetooth or Bluetooth LE), and respond to a challenge or request for authentication.

Figure 4:
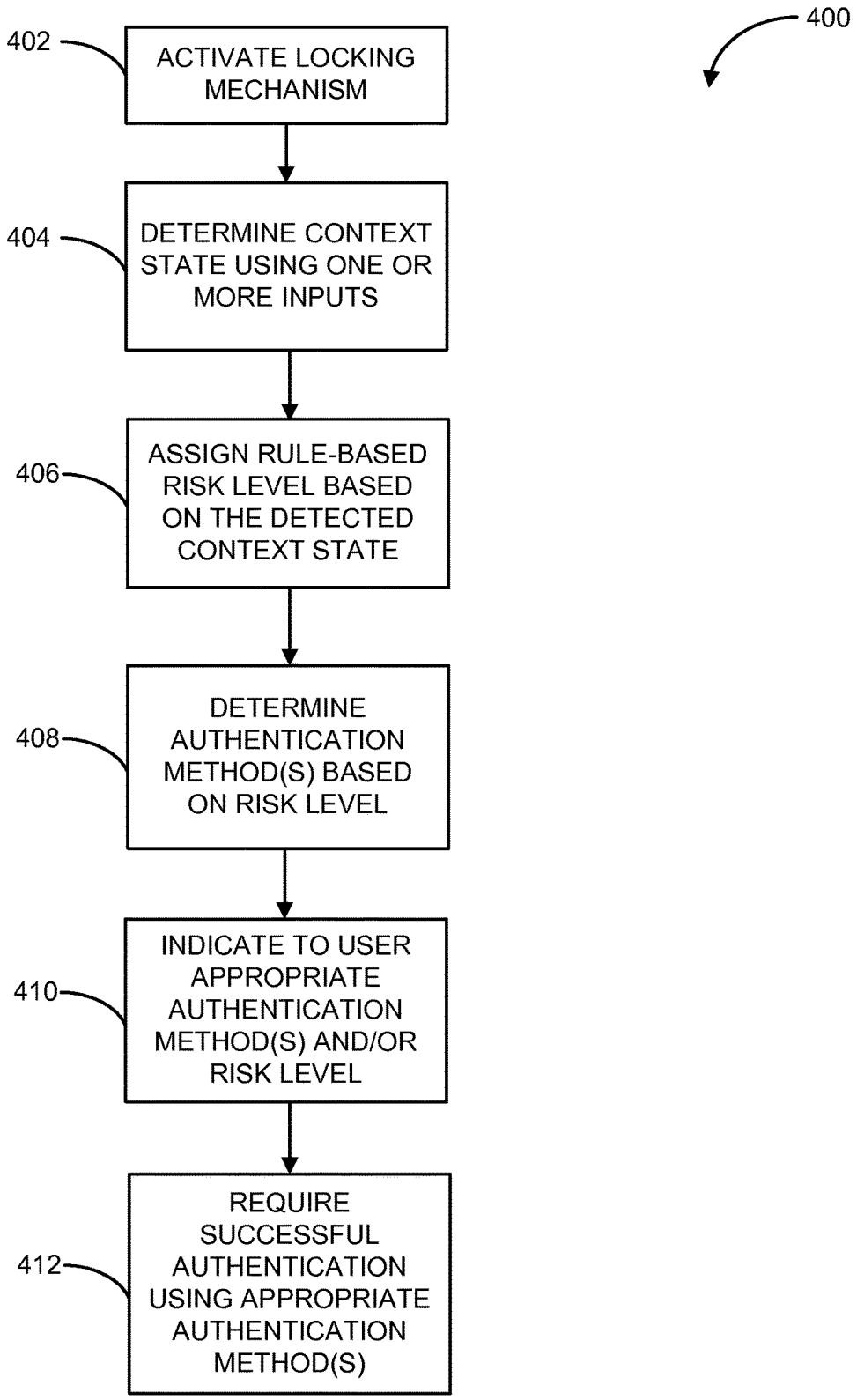
FIG. 4 is a flowchart of an illustrative process for protecting the contents of a smart package in accordance with various embodiments of the invention.

FIG. 4 is a flowchart of an illustrative process for protecting the contents of a smart package in accordance with various embodiments of the invention. The process for protecting the contents of a smart package begin at step 402 when a locking mechanism on the package is activated to lock the package.

At step 404, a context state of a smart package is determined using one or more inputs.

At step 406, a risk level is assigned based on one or more rules that are associated with the context state.

At step 408, at least one authentication method is determined based on the risk level.

At step 410, at least one appropriate authentication method and/or risk level is indicated to a user or a requestor.

Finally, at step 412, to permit an enclosure to unlock, a successful authentication using the one or more appropriate authentication methods at the appropriate risk level is required.

Figure 5:
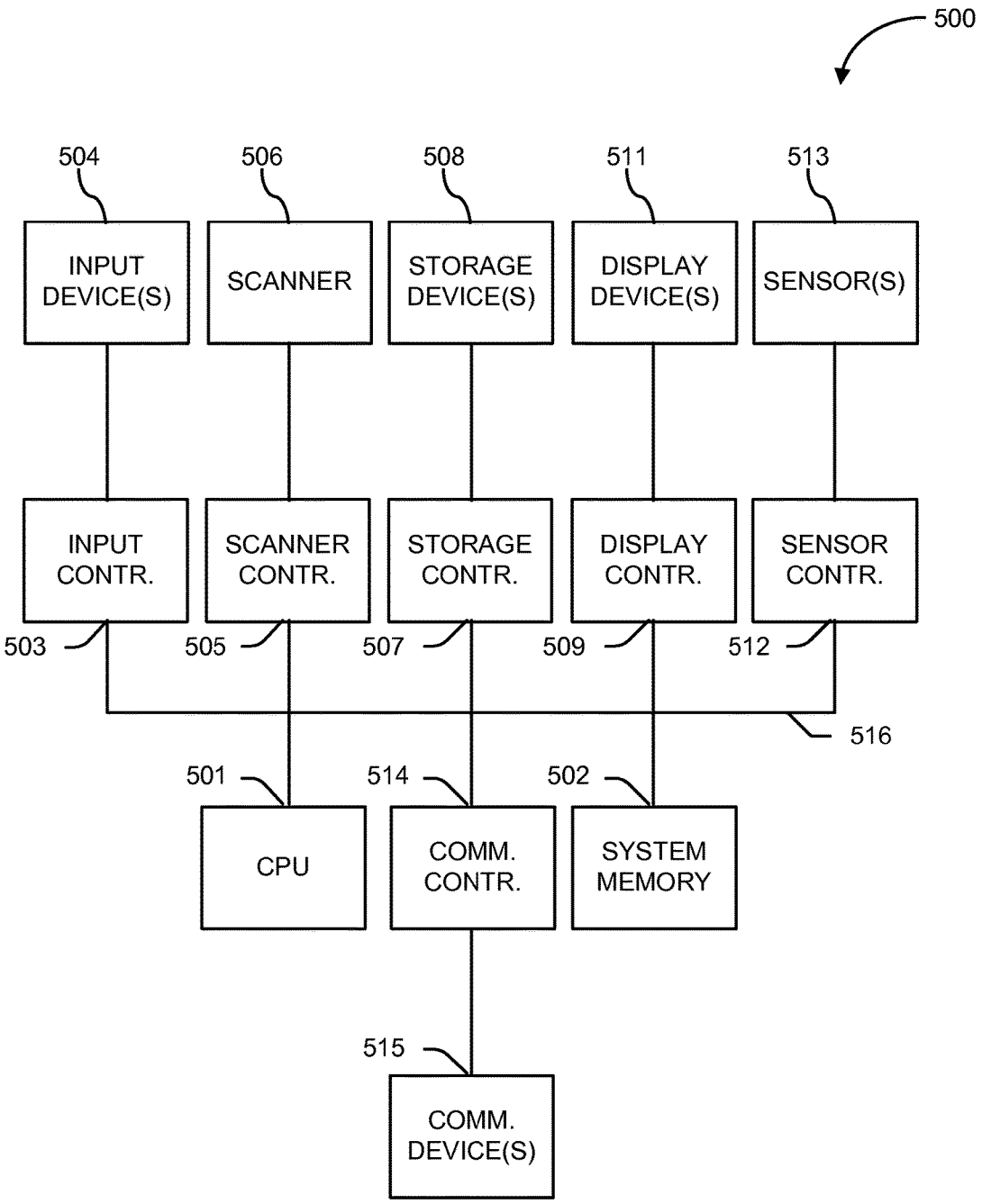
FIG. 5 illustrates a simplified block diagram of an information handling system comprising a security system, according to various embodiments of the present invention.

FIG. 5 depicts a simplified block diagram of an information handling system/computing system comprising a security system, according to various embodiments of the present invention. It will be understood that the functionalities shown for system 500 may operate to support various embodiments of an information handling system—although it shall be understood that an information handling system may be differently configured and include different components. As illustrated in FIG. 5, system 500 includes a central processing unit (CPU) 501 that provides computing resources and controls the computer. CPU 501 may be implemented with a microprocessor or the like, and may also include a graphics processor and/or a floating point coprocessor for mathematical computations. System 500 may also include a system memory 502, which may be in the form of random-access memory (RAM) and read-only memory (ROM).

A number of controllers and peripheral devices may also be provided, as shown in FIG. 5. An input controller 503 represents an interface to various input device(s) 504, such as a keyboard, touch display, mouse, or stylus. There may also be a scanner controller 505, which communicates with a scanner 506. System 500 may also include a storage controller 507 for interfacing with one or more storage devices 508 each of which includes a storage medium such as magnetic tape or disk, or an optical medium that might be used to record programs of instructions for operating systems, utilities and applications which may include embodiments of programs that implement various aspects of the present invention. Storage device(s) 508 may also be used to store processed data or data to be processed in accordance with the invention. System 500 may also include a display controller 509 for providing an interface to a display device 511, which may be a cathode ray tube (CRT), a thin film transistor (TFT) display, or other type of display. The computing system 500 may also include a printer controller 512 for communicating with a printer 513. A communications controller 514 may interface with one or more communication devices 515, which enables system 500 to connect to remote devices through any of a variety of networks including the Internet, an Ethernet cloud, an FCoE/DCB cloud, a local area network (LAN), a wide area network (WAN), a storage area network (SAN) or through any suitable electromagnetic carrier signals including infrared signals.

In the illustrated system, all major system components may connect to a bus 516, which may represent more than one physical bus. However, various system components may or may not be in physical proximity to one another. For example, input data and/or output data may be remotely transmitted from one physical location to another. In addition, programs that implement various aspects of this invention may be accessed from a remote location (e.g., a server) over a network. Such data and/or programs may be conveyed through any of a variety of machine-readable medium including, but are not limited to: magnetic media such as hard disks, floppy disks, and magnetic tape; optical media such as CD-ROMs and holographic devices; magneto-optical media; and hardware devices that are specially configured to store or to store and execute program code, such as application specific integrated circuits (ASICs), programmable logic devices (PLDs), flash memory devices, and ROM and RAM devices.

Embodiments of the present invention may be encoded upon one or more non-transitory computer-readable media with instructions for one or more processors or processing units to cause steps to be performed. It shall be noted that the one or more non-transitory computer-readable media shall include volatile and non-volatile memory. It shall be noted that alternative implementations are possible, including a hardware implementation or a software/hardware implementation. Hardware-implemented functions may be realized using ASIC(s), programmable arrays, digital signal processing circuitry, or the like. Accordingly, the "means" terms in any claims are intended to cover both software and hardware implementations. Similarly, the term "computer-readable medium or media" as used herein includes software and/or hardware having a program of instructions embodied thereon, or a combination thereof. With these implementation alternatives in mind, it is to be understood that the figures and accompanying description provide the functional information one skilled in the art would require to write program code (i.e., software) and/or to fabricate circuits (i.e., hardware) to perform the processing required.

It shall be noted that embodiments of the present invention may further relate to computer products with a non-transitory, tangible computer-readable medium that have computer code thereon for performing various computer-implemented operations. The media and computer code may be those specially designed and constructed for the purposes of the present invention, or they may be of the kind known or available to those having skill in the relevant arts. Examples of tangible computer-readable media include, but are not limited to: magnetic media such as hard disks, floppy disks, and magnetic tape; optical media such as CD-ROMs and holographic devices; magneto-optical media; and hardware devices that are specially configured to store or to store and execute program code, such as application specific integrated circuits (ASICs), programmable logic devices (PLDs), flash memory devices, and ROM and RAM devices. Examples of computer code include machine code, such as produced by a compiler, and files containing higher level code that are executed by a computer using an interpreter. Embodiments of the present invention may be implemented in whole or in part as machine-executable instructions that may be in program modules that are executed by a processing device. Examples of program modules include libraries, programs, routines, objects, components, and data structures. In distributed computing environments, program modules may be physically located in settings that are local, remote, or both.

One skilled in the art will recognize no computing system or programming language is critical to the practice of the present invention. One skilled in the art will also recognize that a number of the elements described above may be physically and/or functionally separated into sub-modules or combined together.

It will be appreciated to those skilled in the art that the preceding examples and embodiment are exemplary and not limiting to the scope of the present invention. It is intended that all permutations, enhancements, equivalents, combinations, and improvements thereto that are apparent to those skilled in the art upon a reading of the specification and a study of the drawings are included within the true spirit and scope of the present invention.

What is claimed is:

1. A dynamic authentication adaptor for protecting goods, the dynamic authentication adaptor comprising:

a context state detector coupled to a locking mechanism that is designed to secure access to a content of a package, the context state detector is configured to determine a context state of the package;

a security state machine coupled to receive the context state from the context state detector, the security state machine determines a risk level associated with that context state; and an authentication module coupled to the security state machine, the authentication module determines one or more authentication methods based on the risk level and applies the one or more authentication methods.

2. The dynamic authentication adaptor according to claim 1, wherein context state detector comprises a sensor to detect a physical characteristic associated with the package.

3. The dynamic authentication adaptor according to claim 1, wherein the authentication module is configured to associate a plurality of security states with the one or more authentication methods.

4. The dynamic authentication adaptor according to claim 1, wherein the context state detector comprises at least one of a location sensor and a vibration sensor to detect a transportation state.

5. The dynamic authentication adaptor according to claim 1, wherein the package is a tamperproof design that is capable of being locked.

6. The dynamic authentication adaptor according to claim 1, wherein determining the risk level is based on one or more predetermined rules associated with the context state.

7. A method to protect access to the content of a package, the method comprising:

determining a context state of a package using one or more inputs;

assigning a risk level to the context state, the risk level being associated with the context state;

determining one or more authentication methods based on the risk level;

indicating to a user the one or more authentication methods; and requiring a successful authentication using the one or more authentication methods based on the risk level to permit an enclosure to unlock.

8. The method according to claim 7, further comprising, in response to the context state being undetermined reverting to a default risk level.

9. The method according to claim 7, wherein upon detection of predetermined number of failed authentication attempts, the package renders unusable its content.

10. The method according to claim 7, wherein the risk level is determined in predetermined intervals of time.

11. The method according to claim 7, wherein the context state comprises one of vibration data and location data.

12. The method according to claim 7, wherein determining the context state comprises detecting a tampering.

13. The method according to claim 7, wherein determining the context state comprises querying sensors that monitor one or more physical characteristics associated with the package.

14. The method according to claim 7, wherein the one or more authentication methods comprise a biometric authentication.

15. An enclosure comprising a dynamic authentication adaptor for protecting goods, the enclosure comprising:

a lock designed to secure access to a content of the enclosure;

a context state detector coupled to the lock and the enclosure, the context state detector configured to determine a context state of the enclosure;

a security state machine coupled to receive the context state from the context state detector, the security state machine determines a risk level associated with that context state; and an authentication module coupled to the security state machine, the authentication module determines one or more authentication methods based on the risk level and applies the one or more authentication methods.

16. The enclosure according to claim 15, wherein the context state detector determines the risk level in response to detecting a predetermined event.

17. The enclosure according to claim 15, wherein the context state detector comprises a sensor to detect a physical characteristic associated with the enclosure.

18. The enclosure according to claim 15, wherein the context state detector comprises at least one of a location sensor and a vibration sensor to detect a transportation state.

19. The enclosure according to claim 15, wherein the authentication module is configured to associate a plurality of security states with the one or more authentication methods.

20. The enclosure according to claim 15, comprising a computing system to securely communicate with an external device.

* * * * *